US012427360B2

(12) United States Patent
Li et al.

(10) Patent No.: US 12,427,360 B2
(45) Date of Patent: Sep. 30, 2025

(54) ADJUSTABLE DUMBBELL

(71) Applicants: Ningbo Tidal Industrial Design Co., Ltd, Ningbo (CN); Zhejiang Qili Health Technology Ltd., Jinhua (CN)

(72) Inventors: Zhan Li, Ningbo (CN); Gaowang Weng, Yongkang (CN)

(73) Assignees: Ningbo Tidal Industrial Design Co., Ltd, Ningbo (CN); Zhejiang Qili Health Technology Ltd., Jinhua (CN)

( * ) Notice: Subject to any disclaimer, the term of this patent is extended or adjusted under 35 U.S.C. 154(b) by 77 days.

(21) Appl. No.: 18/400,170

(22) Filed: Dec. 29, 2023

(65) Prior Publication Data

US 2025/0025738 A1 Jan. 23, 2025

(30) Foreign Application Priority Data

Jul. 21, 2023 (CN) ..... 202310905962.0
Jul. 21, 2023 (CN) ..... 202321934513.0
Jul. 21, 2023 (CN) ..... 202321938635.7
Jul. 21, 2023 (CN) ..... 202321939347.3

(51) Int. Cl.
*A63B 21/075* (2006.01)
*A63B 21/072* (2006.01)

(52) U.S. Cl.
CPC ..... *A63B 21/0726* (2013.01); *A63B 21/0728* (2013.01); *A63B 21/075* (2013.01)

(58) Field of Classification Search
CPC ..... A63B 21/072; A63B 21/0726; A63B 21/7028; A63B 21/075
See application file for complete search history.

(56) References Cited

U.S. PATENT DOCUMENTS

2010/0304939 A1* 12/2010 Svenberg ..... A63B 21/075 482/108
2015/0367164 A1* 12/2015 Myre ..... A63B 21/0726 482/139
2019/0168059 A1* 6/2019 Svenberg ..... A63B 21/00069
2022/0331641 A1* 10/2022 Weng ..... A63B 21/075
2023/0264067 A1* 8/2023 Wang ..... A63B 21/0726

FOREIGN PATENT DOCUMENTS

CN 215781228 U * 2/2022
CN 112587858 B * 8/2024 ..... A63B 21/0726
CN 222238673 U * 12/2024

* cited by examiner

*Primary Examiner* — Joshua T Kennedy

(57) ABSTRACT

There is provided an adjustable dumbbell including a dumbbell body, dumbbell plates, and a dumbbell base for placing the dumbbell body and dumbbell plates. The dumbbell implements transmission in a mode of meshing internal gear rings with gear sets and meshing the gear sets with teeth on telescopic sleeves, such that a high transmission efficiency is achieved, a torque of a handle can be more efficiently converted and transmitted to the telescopic sleeves, the telescopic sleeves can make a faster response, and a weight adjustment speed of the dumbbell is increased. A structure used in the transmission mode has greater load-bearing capacity, has higher wear resistance than a structure in a nut and lead screw mode, and there will be no situation where the dumbbell cannot be used due to thread wear after long-term use.

10 Claims, 17 Drawing Sheets

ADJUSTABLE DUMBBELL

CROSS-REFERENCE TO RELATED APPLICATIONS

This is a U. S. patent application which claims the priority and benefit of Chinese Patent Application Number 202310905962.0, filed on Jul. 21, 2023, and benefit of Chinese Patent Application Number 202321934513.0, filed on Jul. 21, 2023, and benefit of Chinese Patent Application Number 202321938635.7, filed on Jul. 21, 2023, and benefit of Chinese Patent Application Number 2023219393473, filed on Jul. 21, 2023, the disclosure of which is incorporated herein by reference in its entirety.

TECHNICAL FIELD

The present disclosure relates to the technical field of fitness equipment, and specifically to an adjustable dumbbell.

BACKGROUND

As conventional fitness equipment, dumbbells have the limitation of fixed weight during exercise and thus cannot meet the requirements for different training stages and goals. In order to solve this problem, adjustable dumbbells emerge. The adjustable dumbbells can adjust the weight to meet the requirements of different training intensities and have better applicability. An adjustable dumbbell mainly includes a holding rod assembly and a counterweight assembly, where the counterweight assembly mainly includes dumbbell plates, a plurality of dumbbell plate mounting positions adjacently arranged are arranged at each of two ends of the holding rod assembly, and the holding rod assembly is provided with a telescopic rod capable of extending to the dumbbell plate mounting positions. A number of dumbbell plates can be changed through the extension of the telescopic rod to adjust the weight of the dumbbell. The adjustable dumbbells not can provide flexible training modes but also provide users with personalized fitness experience.

However, the existing adjustable dumbbell has great defects for usage. In the existing adjustable dumbbell, the telescopic rod that is configured to mount the dumbbell plates is adjusted in a nut and lead screw mode, which can result in a low transmission efficiency, and when nuts and lead screws are loosened and cannot be used due to severe wear of threads on the nuts and the lead screws after long-term use. In the existing adjustable dumbbell, the telescopic rod that is configured to mount the dumbbell plates can be easy to be jammed, resulting in insufficiently smooth and reliable weight adjustment of the dumbbell. Gear positions for adjusting the weight of the existing adjustable dumbbell are not clear enough to be viewed, such that the dumbbell can be in a neutral state. There is a situation where the dumbbell plates are not completely mounted, which easily leads to falling of the dumbbell plates, such that the use is not safe and reliable enough. An adjustment function of the existing adjustable dumbbell is required to be locked manually before use, and the weight adjustment function is required to be enabled again during weight adjustment, and the use is not convenient enough, and during use for training, it is easy to forget to lock the weight adjustment function to cause accidents.

SUMMARY

In view of the problems in the prior art, the present disclosure provides an adjustable dumbbell.

To solve the technical problems, the present disclosure adopts the following technical solution: an adjustable dumbbell includes a dumbbell body, dumbbell plates, and a dumbbell base for placing the dumbbell body and the dumbbell plates. The dumbbell body includes a dumbbell rod assembly and two dumbbell clamp assemblies configured to mount the dumbbell plates; the dumbbell rod assembly includes a shaft center in a prismatic structure and a handle arranged in a middle of the shaft center in a running fitting manner; the two dumbbell clamp assemblies are fixed to two ends of the shaft center, respectively; each of the two dumbbell clamp assemblies includes a limit rack configured to mount the dumbbell plates, and a fixing disk and a tail iron plate configured to limit the mounted dumbbell plates; the fixing disk and the tail iron plate are fixed to two ends of the limit rack, respectively; an expansion chute is horizontally provided in a position, corresponding to the shaft center, of a middle of the limit rack; the two ends of the shaft center are both sleeved with telescopic sleeves capable of sliding into the two expansion chutes and configured to fix the dumbbell plates; gear sets are provided in a running fitting manner at positions, located inside the two fixing disks, of one ends of the two limit racks; each of the two fixing disks is internally provided with an internal gear ring driven by the handle in a running fitting manner; the two internal gear rings drive the two telescopic sleeves by the two gear sets respectively to move; and limit blocks capable of locking rotation of the internal gear rings are arranged at positions, located inside the two fixing disks, of the one end of each of the two limit racks. According to the dumbbell, the dumbbell plates are fixed using the telescopic sleeves, and a number of the dumbbell plates fixed by the two telescopic sleeves is adjusted by changing extension lengths of the two telescopic sleeves to adjust a weight of the dumbbell; the dumbbell is internally provided with the internal gear rings and the gear sets meshed therewith; and through cooperative transmission of the internal gear rings and the gear sets, a user needs to rotate the handle to drive the internal gear rings to rotate during the weight adjustment of the dumbbell.

Each of the gear sets includes a master gear and two driving gears; the master gear is meshed with teeth of an inner ring of the internal gear ring; two sides of the master gear are both provided with pinions in a synchronous running fitting manner; the two driving gears are meshed with the two pinions, respectively; each of the telescopic sleeves is provided with a tooth space; and the telescopic sleeve is meshed with the two driving gears through the tooth space. According to the dumbbell, the shaft center in the prismatic structure is arranged, such that the telescopic sleeves can be effectively prevented from rotating on the shaft center, the situation where the gear sets cannot be matched with the tooth spaces on the telescopic sleeves due to axial rotation of the telescopic sleeves is avoided, and the horizontal movement of the telescopic sleeves is more stable; and the two driving gears are arranged on the gear set and both matched with the tooth space on the telescopic sleeve, such that it is ensured that two sides of the telescopic sleeve are stressed stably, thus effectively solving the problem that the telescopic sleeve is prone to shaking and jamming during the horizontal movement.

Preferably, one side of the fixing disk is provided with a dial plate in a running fitting manner; one side of the dial plate is marked with scales; one side of the fixing disk is provided with a marking groove pointing to the scales of the dial plate; a center of the dial plate is fixed to the handle; one side, away from the handle, of the dial plate is fixed to the internal gear ring inside the fixing disk; and the handle drives the internal gear ring by the dial plate to rotate. According to the dumbbell, the dial plate with the scales and the fixing disk with the marking groove are arranged between the handle and the internal gear ring, and the scales on the dial plate are matched with the marking groove on the fixing disk, such that a required weight can be conveniently selected and adjusted, and the user can align a specific scale on the dial plate with the marking groove as needed, thereby achieving precise weight adjustment.

Preferably, a positioning plate is fixed between the dial plate and the internal gear ring; the positioning plate rotates synchronously with the dial plate; one side, away from the dial plate, of the positioning plate is alternately provided with guide grooves and guide surfaces in an equal-radian manner; two limit barrels are horizontally fixed to positions, located in the fixing disk, of the one end of the limit rack; a compression spring is horizontally fixed in each of the two limit barrels; guide pins capable of being compressed into the limit barrels are connected to end parts of the two compression springs; and when abutting against the guide surfaces, the two guide pins tend to slide towards any one of the guide grooves on two sides of each of the guide surfaces, and the positioning plate is driven to rotate, such that the guide pins are located in the guide grooves. According to the dumbbell, the positioning plate is arranged between the dial plate and the internal gear ring, and rotates synchronously with the dial plate; the guide pins squeeze the positioning plate under elastic force of the compression springs; the side surface of the positioning plate is alternately provided with the guide grooves and the guide surfaces; when the two guide pins abut against the guide surfaces, the marking groove is not corresponding to any scale on the dial plate, and the adjustment of the dumbbell is in a neutral state, such that the dumbbell plates at the end parts of the telescopic sleeve are not fully penetrated, and there is a risk of falling; when the two guide pins are located in the guide grooves, the marking groove is corresponding to one of the scales on the dial plate, and the adjustment of the dumbbell is in a gear position, such that the dumbbell plates at the end parts of the telescopic sleeve are completely penetrated; and because the guide pins tend to slide towards any one of the guide grooves on the two sides of each of the guide surfaces when abutting against the guide surfaces, the guide pins are prone to falling into the guide grooves, and when the handle is rotated and adjusted to adjust the weight of the dumbbell, the dumbbell is not easily adjusted to be in the neutral state.

Preferably, each of the dumbbell plates is provided with a clamping groove into which the limit rack is capable of being placed from top to bottom; an expanded hole for each of the telescopic sleeves to penetrate through is horizontally provided in a center of the dumbbell plate; a diameter of the telescopic sleeve is greater than a width of the clamping groove; and the telescopic sleeve penetrates into the expanded hole to fix the dumbbell plate to the limit rack. Because the diameter of the telescopic sleeves is greater than the width of the clamping grooves, the dumbbell plates can be fixed to the limit racks after the telescopic sleeves penetrate through the expanded holes; and the limit racks are placed in the clamping grooves, and the telescopic sleeves penetrate through the expanded holes to fix the dumbbell plates, such that it can be ensured that the dumbbell plates are firmly connected to the limit racks, thus avoiding the situation where the dumbbell plates are loosened or separated.

Preferably, the limit rack is provided with a plurality of division plates; the plurality of division plates divides the limit rack into a plurality of plate positions for fixing the dumbbell plates; and an outermost part of the clamping groove on each of the dumbbell plates is in an inverted splayed structure. The division plates are arranged on the limit rack to separate the mounted dumbbell plates from one another; and the outermost part of the clamping groove is set to be in the inverted splayed structure for guiding the process of placing the limit rack in the clamping grooves, such that the limit rack can be more easily placed in the clamping grooves.

Preferably, one side of the internal gear ring is fixedly provided with an annular rotary table; an inner ring of the rotary table is provided with a plurality of locking grooves in an equal-radian manner; lowermost parts of end parts of the limit rack are both fixedly provided with limit frames; the limit frames are internally provided with the limit blocks in a sliding fitting manner; the limit blocks are in an inverted L-shaped structure; locking springs are connected to tops of the limit blocks; tops of the locking springs are connected to interiors of the limit frames; the limit blocks are pressed down into the locking grooves under the action of the locking springs; and the rotation of the internal gear ring is restricted by the rotary table. No matter how to rotate the handle, the limit block is always kept in a state of being corresponding to one of the locking grooves on the rotary table as long as the weight adjustment of the dumbbell is in the gear position; the limit blocks are squeezed by elastic force of the locking springs to be inserted into the locking grooves, such that the rotary table can be fixed; and the internal gear rings and the handle are not rotatable by fixing the rotary tables, and then the telescopic sleeves are not movable, such that the number of the dumbbell plates mounted on the dumbbell is fixed, thus achieving the purpose of locking the required weight of the dumbbell.

Preferably, unlocking ejection blocks are welded at a top of the dumbbell base; the limit blocks are corresponding to the unlocking ejection blocks in position; and after the dumbbell body is placed in the dumbbell base, the unlocking ejection blocks squeeze up the limit blocks, such that the limit blocks are capable of being ejected from the locking grooves. Through the arrangement of the unlocking ejection blocks, after the dumbbell is placed on the dumbbell base, the unlocking ejection blocks squeeze up the limit blocks to eject the limit blocks from the locking grooves, such that the rotary table is restored to a state where the rotary plate is rotatable, and thus the dumbbell is restored to a state where the weight adjustment is available. Through the arrangement of the unlocking ejection blocks, the weight of the dumbbell can be adjusted as long as the dumbbell is put back on the dumbbell base after training, such that a step of manually unlocking the weight adjustment of the dumbbell is omitted. In addition, once the dumbbell is removed from the dumbbell base, the limit blocks are not supported by the unlocking ejection blocks and pushed directly into the locking grooves by the locking springs, such that a step of manually locking the weight adjustment of the dumbbell is omitted, and the occurrence of accidents caused by the user forgetting to lock a dumbbell weight adjustment function can be avoided.

Preferably, each of two ends of the top of the dumbbell base is provided with a placement groove configured to place a corresponding one of the dumbbell clamp assemblies; a plurality of plate grooves configured to store the dumbbell plates are provided in a position, located in a middle of each of the two placement grooves, of the top of the dumbbell base; and an anti-collision groove is provided in a center of the top of the dumbbell base and is corresponding to the handle in position. The placement grooves at the top of the dumbbell base can be configured to place the dumbbell clamp assemblies, and the plate grooves at the top of the dumbbell base can be configured to place the dumbbell plates. The dumbbell base is arranged, and the placement grooves and the plate grooves are provided on the dumbbell base, such that the dumbbell is not easily lost during use, and it is convenient to classify, arrange and select dumbbells. The anti-collision groove is provided on the dumbbell base, such that a sufficient distance is kept between the top of the dumbbell base and the handle of the dumbbell, thus avoiding the situation where a hand of the user is pinched by the dumbbell base and the handle of the dumbbell during the placement of the dumbbell.

Preferably, the two gear sets are arranged in a central symmetry manner; the two internal gear rings are centrally symmetric; the two internal gear rings rotate synchronously in a same direction; the two internal gear rings drive the two telescopic sleeves by the two gear sets respectively to move synchronously in opposite directions; two ends of the handle are set to be hollow; and the two telescopic sleeves are capable of retracting into the two ends of the handle. The telescopic sleeves are retracted into the handle, such that the telescopic sleeves are not easily exposed outside, thus preventing jamming caused by sundries wound around the telescopic sleeves.

Preferably, a method for using the adjustable dumbbell specifically includes the following steps:

step 1: placing the dumbbell base on a horizontal table or the ground, putting the dumbbell plates into the plate grooves of the dumbbell base, and making openings of the clamping grooves of the dumbbell plates face right above, to ensure that the two telescopic sleeves are completely moved out of the two expansion chutes; aligning the two limit racks on the dumbbell body with the dumbbell plates placed at the two ends of the top of the dumbbell base, respectively; and placing the dumbbell body downwards, such that the limit racks are inserted into the clamping grooves of the dumbbell plates, wherein the two dumbbell clamp assemblies are placed in the two placement grooves at the top of the dumbbell base, and the unlocking ejection blocks on the dumbbell base squeeze up the limit blocks to move the limit blocks out of the locking grooves of the rotary tables, causing the rotary tables to be in a state where the rotary tables are rotatable and adjustable;

step 2: rotating the handle to drive the two dial plates to rotate; and according to fitness requirements, rotating the required weight indicating scales on the dial plates to be aligned with the marking grooves on the fixing disks, wherein during the process of rotating the two dial plates, the two internal gear rings are driven to rotate and drive the two telescopic sleeves by the two gear sets to move away from the handle, and the two telescopic sleeves penetrate through a corresponding number of the dumbbell plates from the expansion chutes based on rotational amplitudes of the dial plates; and step 3: holding the handle with a hand and lifting up the dumbbell body, wherein the dumbbell plates penetrated by the telescopic sleeves are fixed to the dumbbell clamp assemblies because the diameter of the telescopic sleeves is greater than the width of the clamping grooves on the dumbbell plates, moreover, the limit blocks are not squeezed by the unlocking ejection blocks and fall back into the locking grooves of the rotary tables under the elastic force of the locking springs to lock the rotary tables for preventing rotation of the rotary tables, and the internal gear rings, the dial plates, and the handle are all kept in a locked state by locking the rotary tables, such that the user is capable of making exercise according to an adjusted weight.

The present disclosure has the following beneficial effects:

In the present invention, the dumbbell is internally provided with the internal gear rings and the gear sets meshed therewith. Through cooperative transmission of the internal gear rings and the gear sets, the user needs to rotate the handle to drive the internal gear rings to rotate during the weight adjustment of the dumbbell. The mounting weight of the dumbbell is adjusted by rotating the handle, making the dumbbell easier and more convenient to adjust. The dumbbell implements transmission in a mode of meshing the internal gear rings with the gear sets and meshing the gear sets with teeth on the telescopic sleeves. On the one hand, a high transmission efficiency is achieved, a torque of the handle can be more efficiently converted and transmitted to the telescopic sleeves, the telescopic sleeves can make a faster response, and a weight adjustment speed of the dumbbell is increased, such that the usage efficiency of the dumbbell is improved; and on the other hand, a structure used in the transmission mode has greater load-bearing capacity, has higher wear resistance than a structure in a nut and lead screw mode, and there will be no situation where the dumbbell cannot be used due to thread wear after long-term use. In addition, the transmission mode has a higher positioning accuracy and can more accurately control positions of the telescopic sleeves, thereby enabling the telescopic sleeves to fix the dumbbell plates more reliably, effectively preventing the dumbbell plates at end parts of the telescopic sleeves from falling off, and thus achieving the higher safety and reliability of the dumbbell in use.

In the present invention, according to the dumbbell, the shaft center in the prismatic structure is arranged, such that the telescopic sleeves can be effectively prevented from rotating on the shaft center, the situation where the gear sets cannot be matched with the tooth spaces on the telescopic sleeves due to axial rotation of the telescopic sleeves is avoided, the horizontal movement of the telescopic sleeves is more stable, and thus the weight adjustment of the dumbbell is smoother and more reliable; and the two driving gears are arranged on the gear set and both matched with the tooth space on the telescopic sleeve, such that it is ensured that two sides of the telescopic sleeve are stressed stably, thus effectively solving the problem that the telescopic sleeve is prone to shaking and jamming during the horizontal movement, and further improving the stability of the telescopic sleeve during the horizontal movement and the smoothness and reliability of adjusting the dumbbell.

In the present invention, according to the dumbbell, the positioning plate is arranged between the dial plate and the internal gear ring, and rotates synchronously with the dial plate; the guide pins squeeze the positioning plate under elastic force of the compression springs; the side surface of the positioning plate is alternately provided with the guide grooves and the guide surfaces; when the two guide pins abut against the guide surfaces, the marking groove is not corresponding to any scale on the dial plate, and the adjustment of the dumbbell is in the neutral state, such that the dumbbell plates at the end parts of the telescopic sleeve are not fully penetrated, and there is a risk of falling; when the two guide pins are located in the guide grooves, the marking groove is corresponding to one of the scales on the dial plate, and the adjustment of the dumbbell is in the gear position, such that the dumbbell plates at the end parts of the telescopic sleeve are completely penetrated; because the guide pins tend to slide towards any one of the guide grooves on the two sides of each of the guide surfaces when abutting against the guide surfaces, the guide pins are prone to falling into the guide grooves, and when the handle is rotated and adjusted to adjust the weight of the dumbbell, the dumbbell is not easily adjusted to be in the neutral state, making gear shifting more reliable during the weight adjustment of the dumbbell; and the dumbbell plates mounted on the dumbbell are all in a firm state by improving the reliability of the dumbbell during gear shifting, thus reducing the possibility of the dumbbell plates falling, and further improving the safety and reliability of the dumbbell in use.

BRIEF DESCRIPTION OF THE DRAWINGS

The present disclosure is further described below in conjunction with the accompanying drawings and embodiments.

Figure 1:
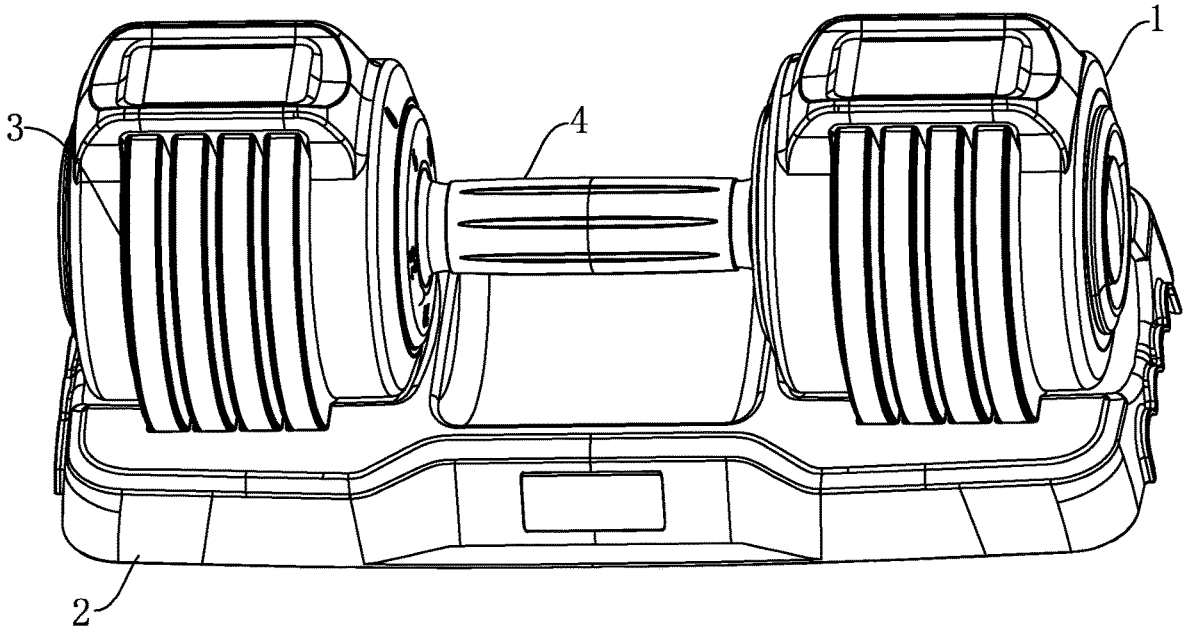
FIG. 1 is a schematic diagram of an overall structure of the present invention.
Figure 2:
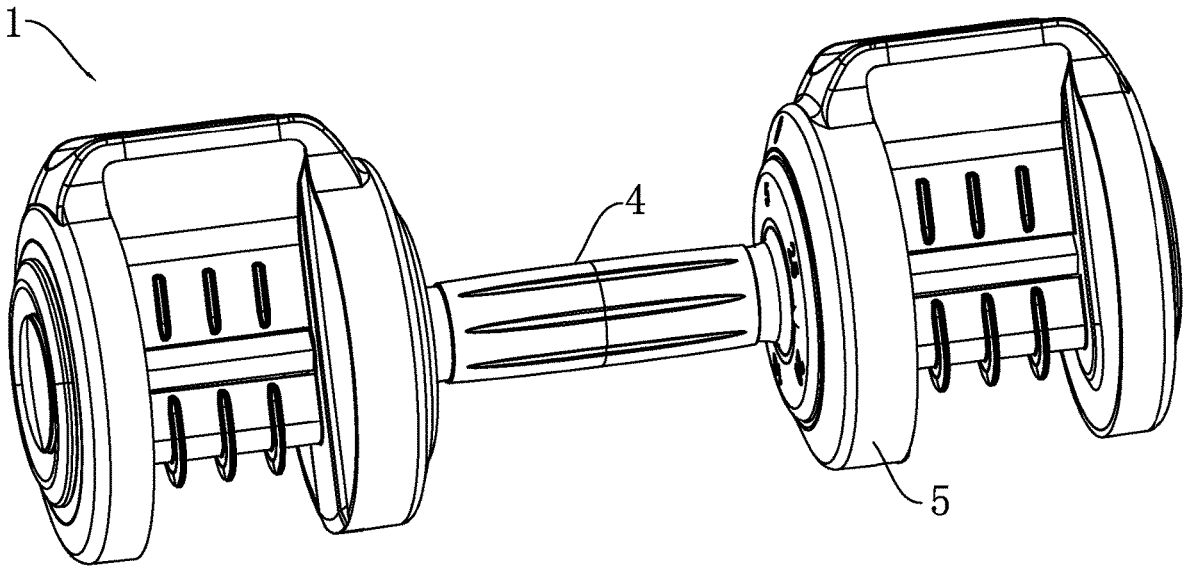
FIG. 2 is a schematic structural diagram of a dumbbell body in the present invention.
Figure 3:
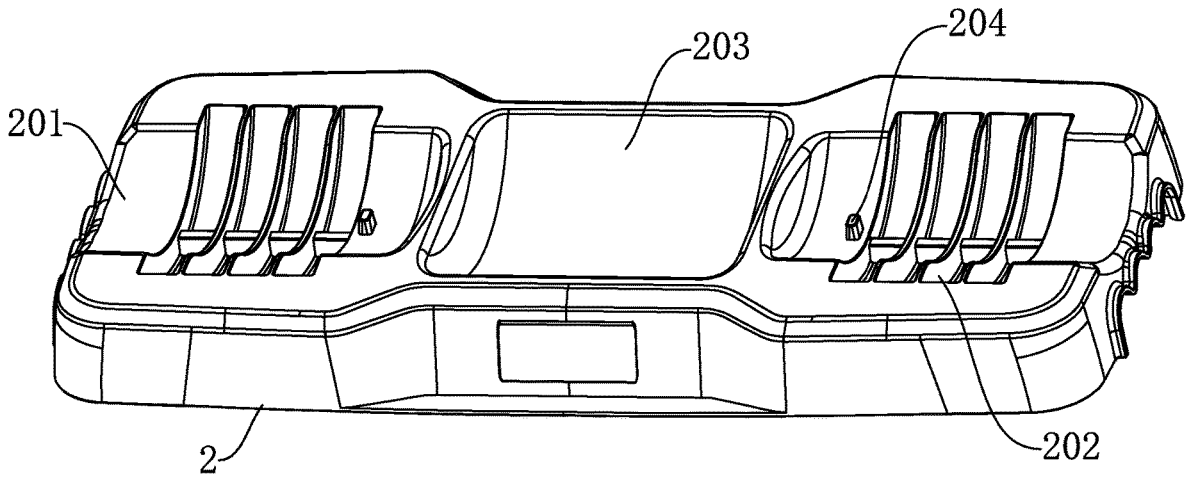
FIG. 3 is a schematic structural diagram of a dumbbell base in the present invention.
Figure 4:
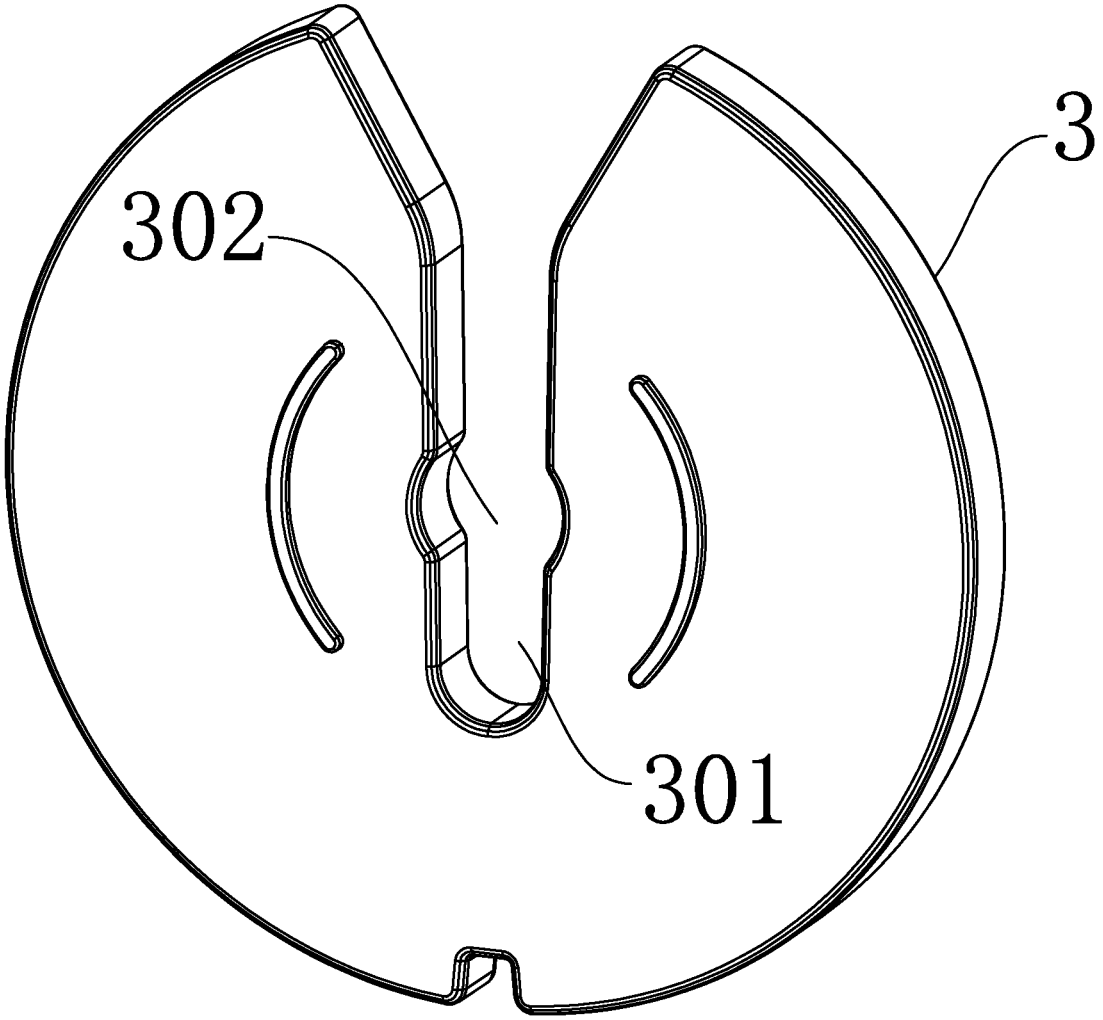
FIG. 4 is a schematic structural diagram of a dumbbell plate in the present invention.
Figure 5:
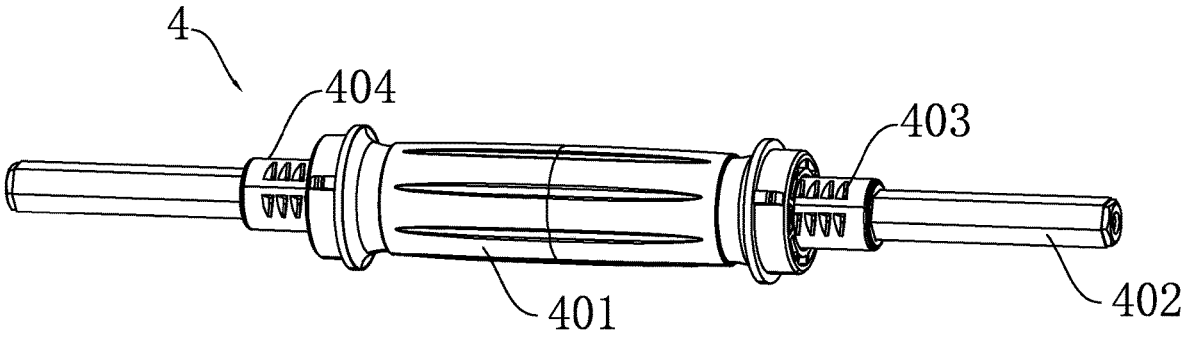
FIG. 5 is a schematic structural diagram of a dumbbell rod assembly in the present invention.
Figure 6:
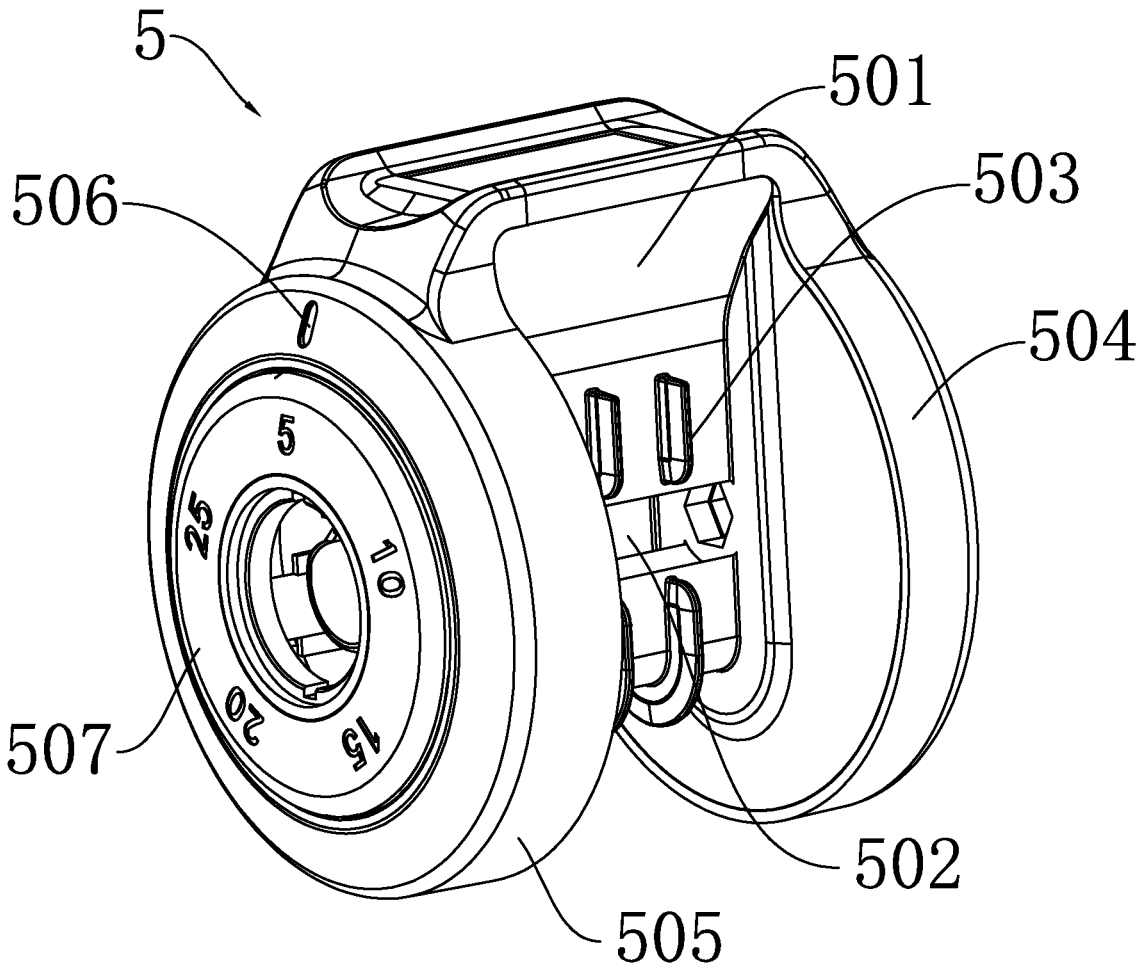
FIG. 6 is a schematic structural diagram of a dumbbell clamp assembly in the present invention.
Figure 7:
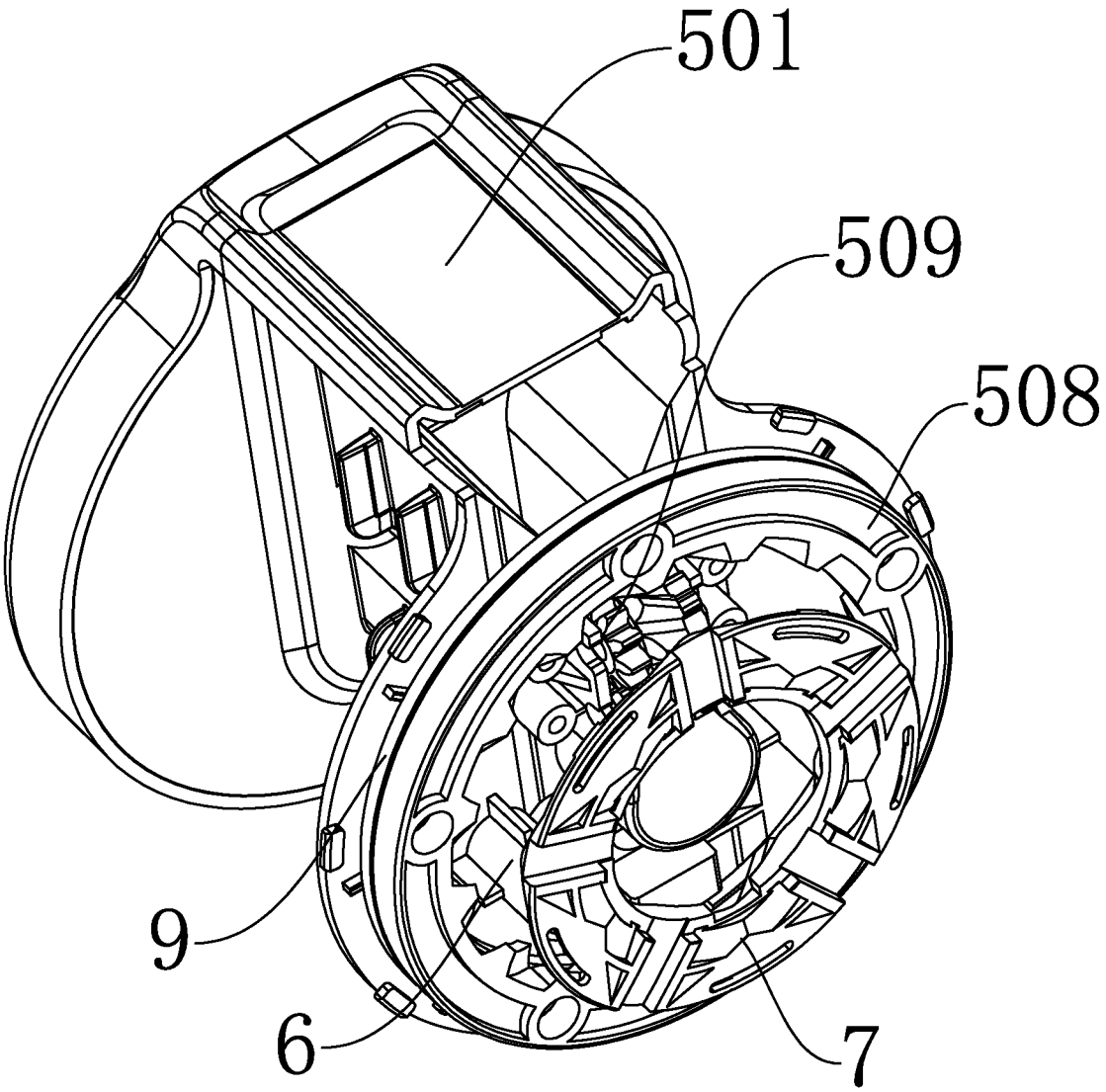
FIG. 7 is a schematic structural diagram of a dumbbell clamp assembly after a fixing disk is removed in the present invention.
Figure 8:
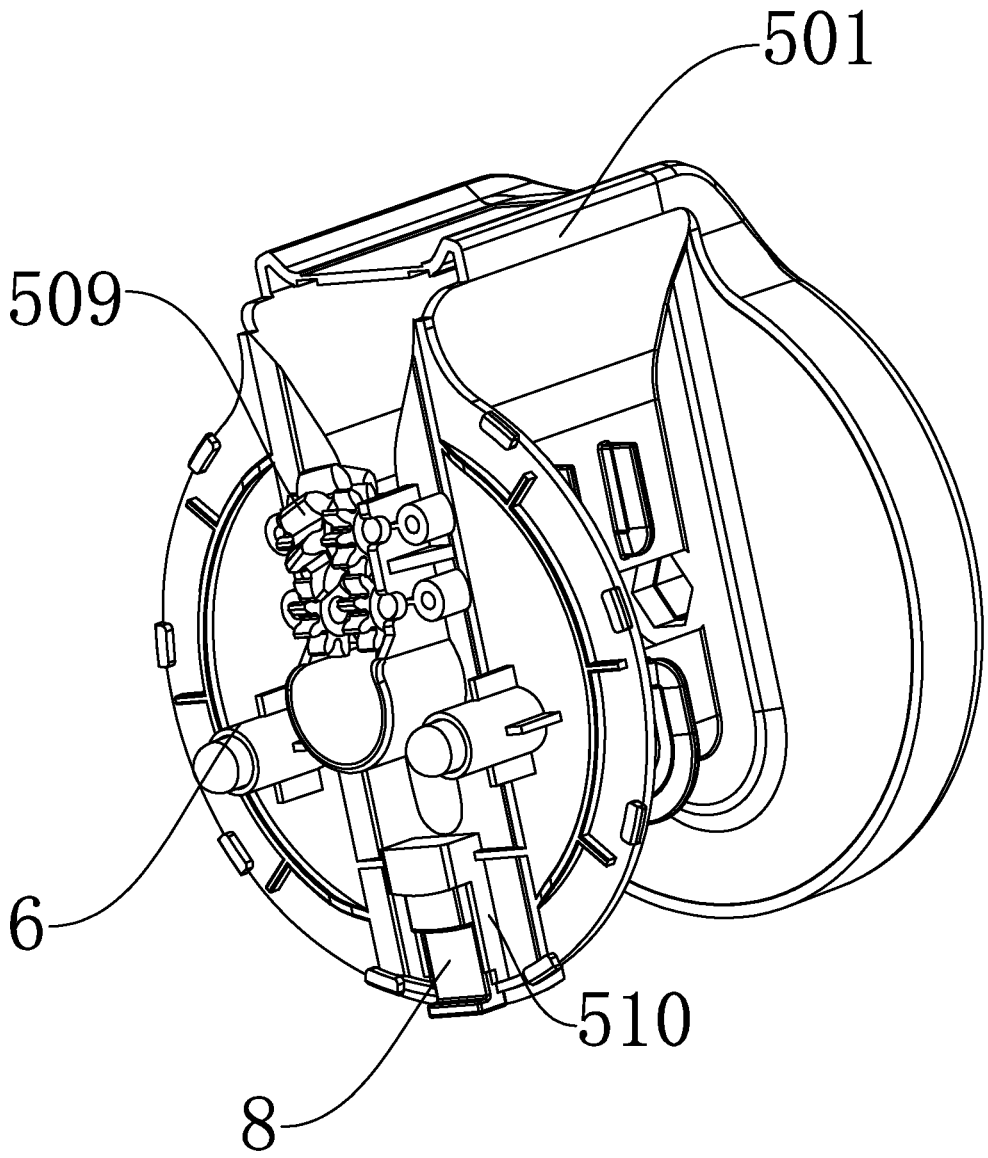
FIG. 8 is a schematic structural diagram of a dumbbell clamp assembly after a fixing disk and a positioning plate are removed in the present invention.
Figure 9:
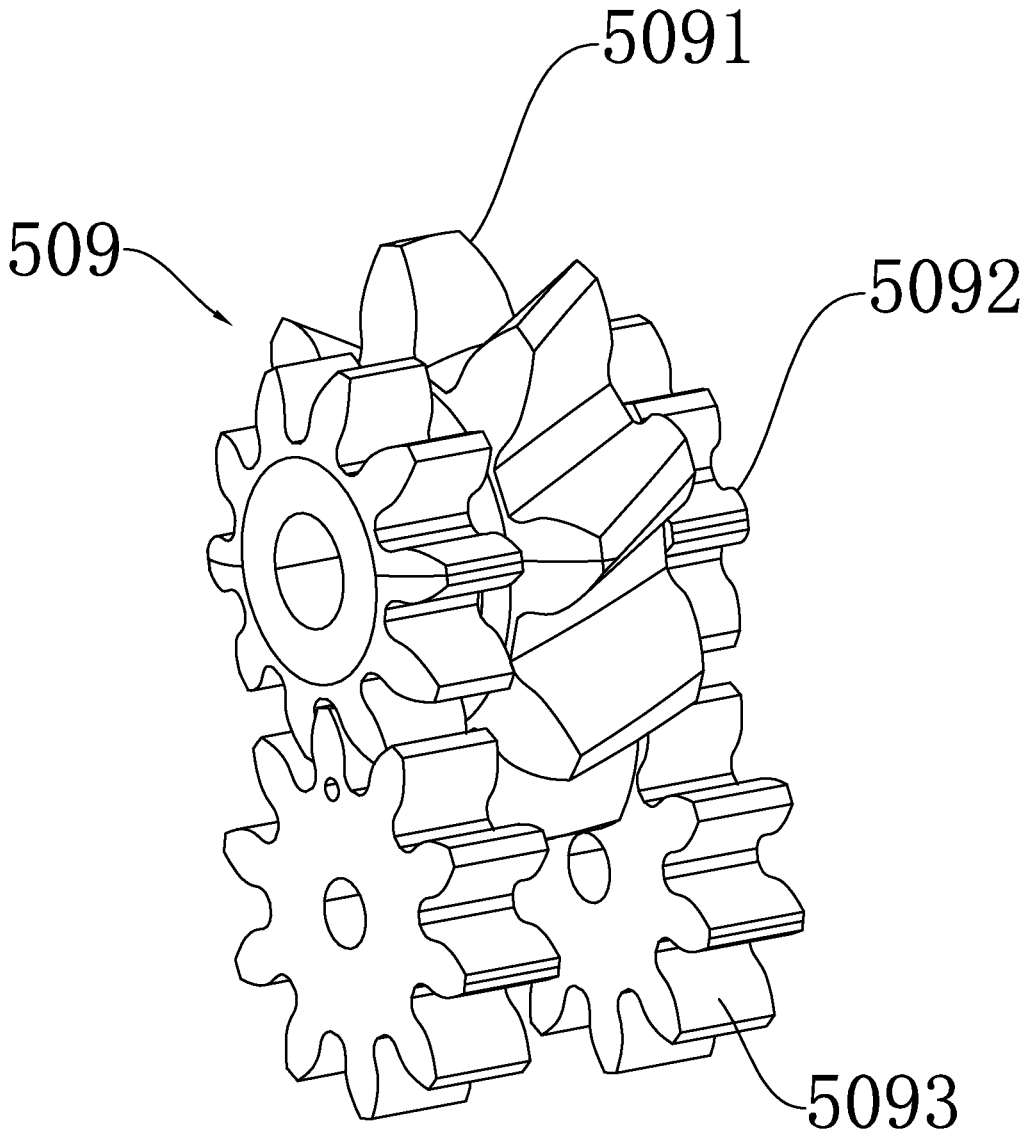
FIG. 9 is a schematic structural diagram of a gear set in the present invention.
Figure 10:
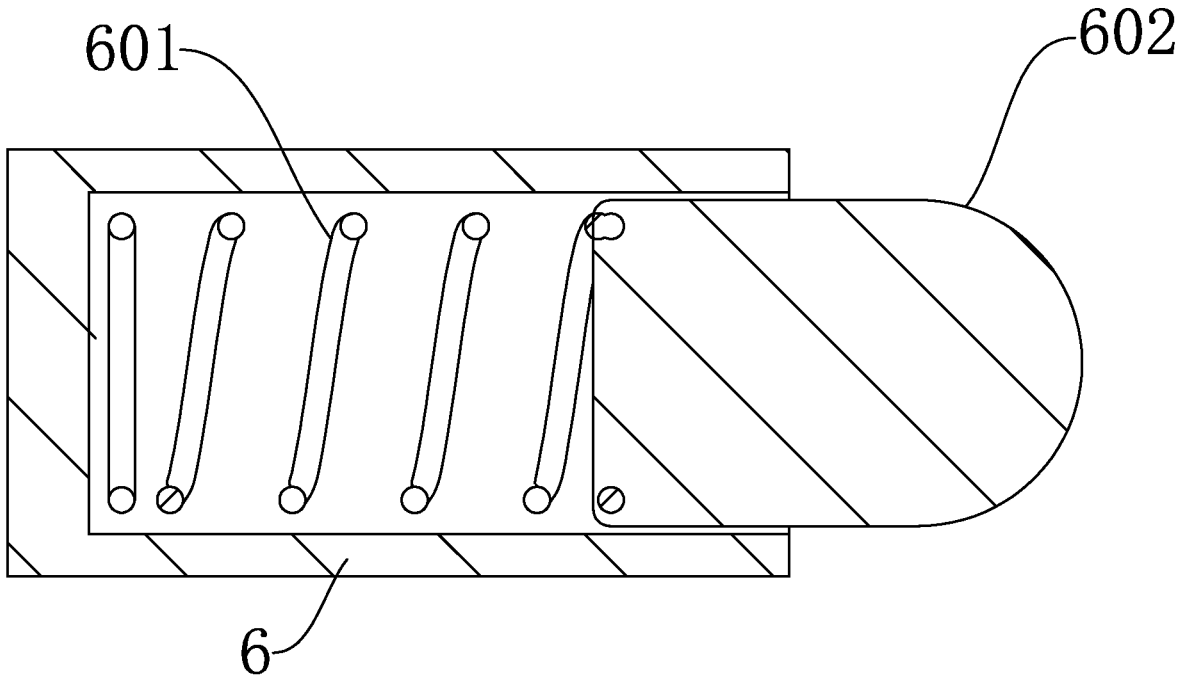
FIG. 10 is a sectional view of a limit barrel in the present invention.
Figure 11:
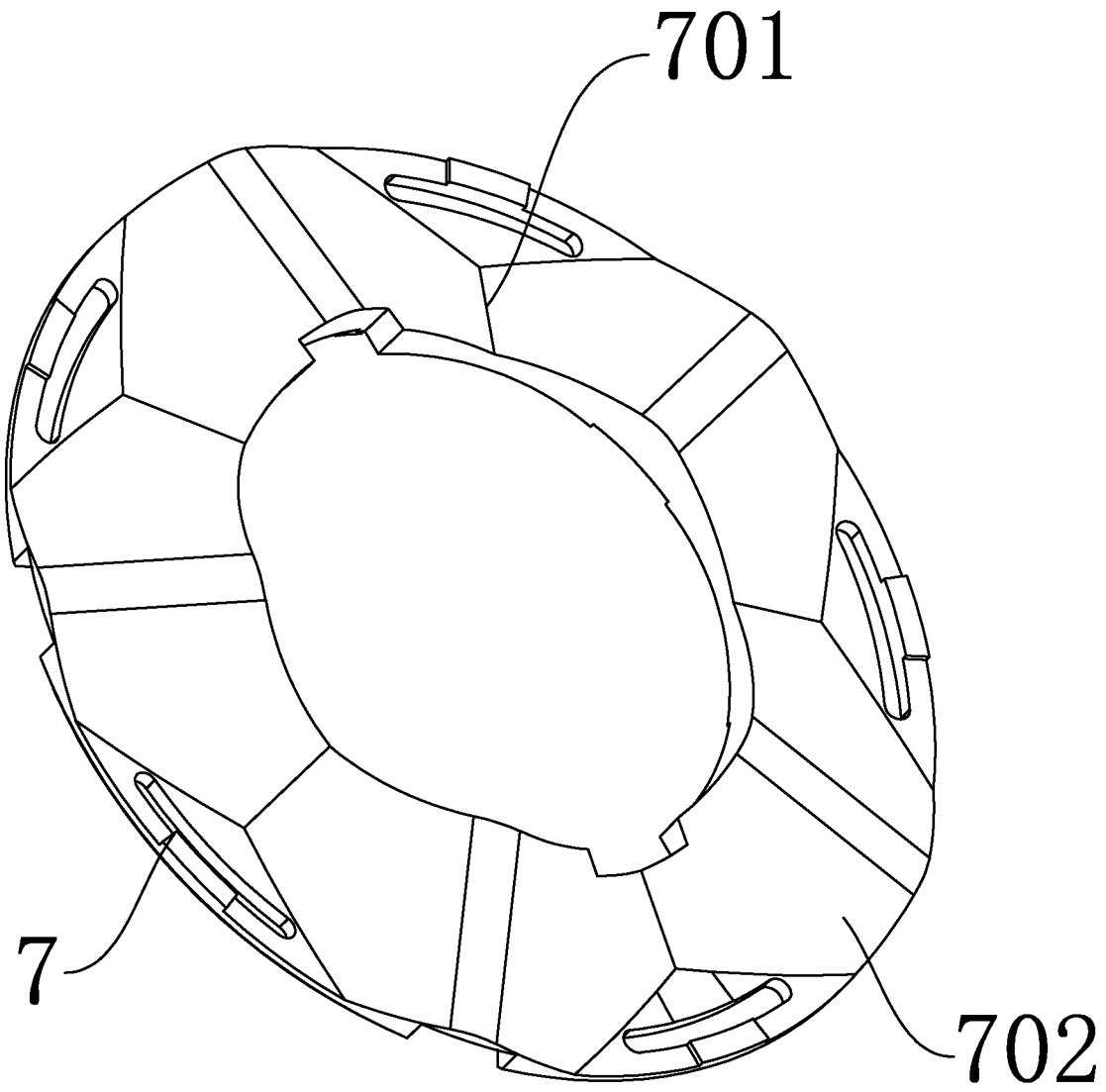
FIG. 11 is a schematic structural diagram of a positioning plate in the present invention.
Figure 12:
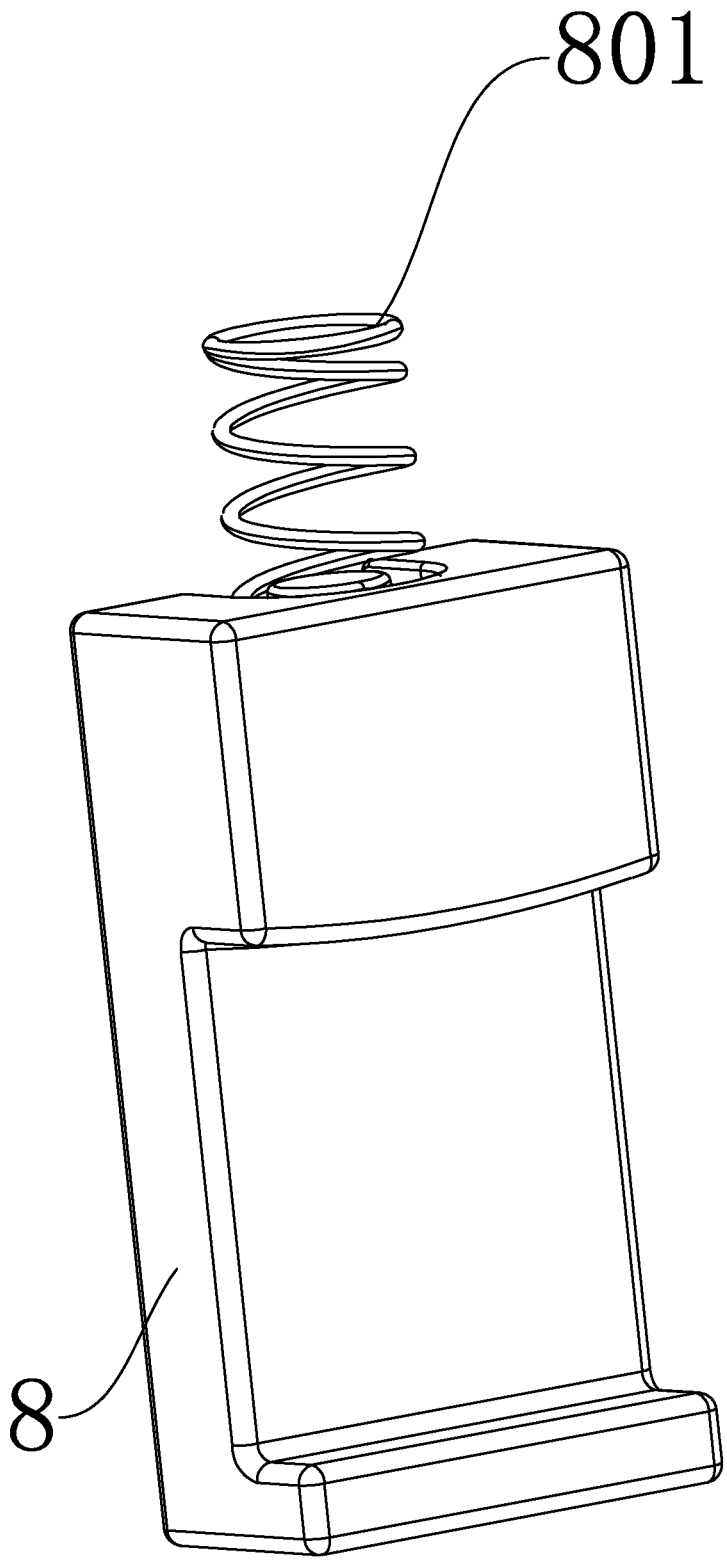
FIG. 12 is a schematic structural diagram of a limit block in the present invention.
Figure 13:
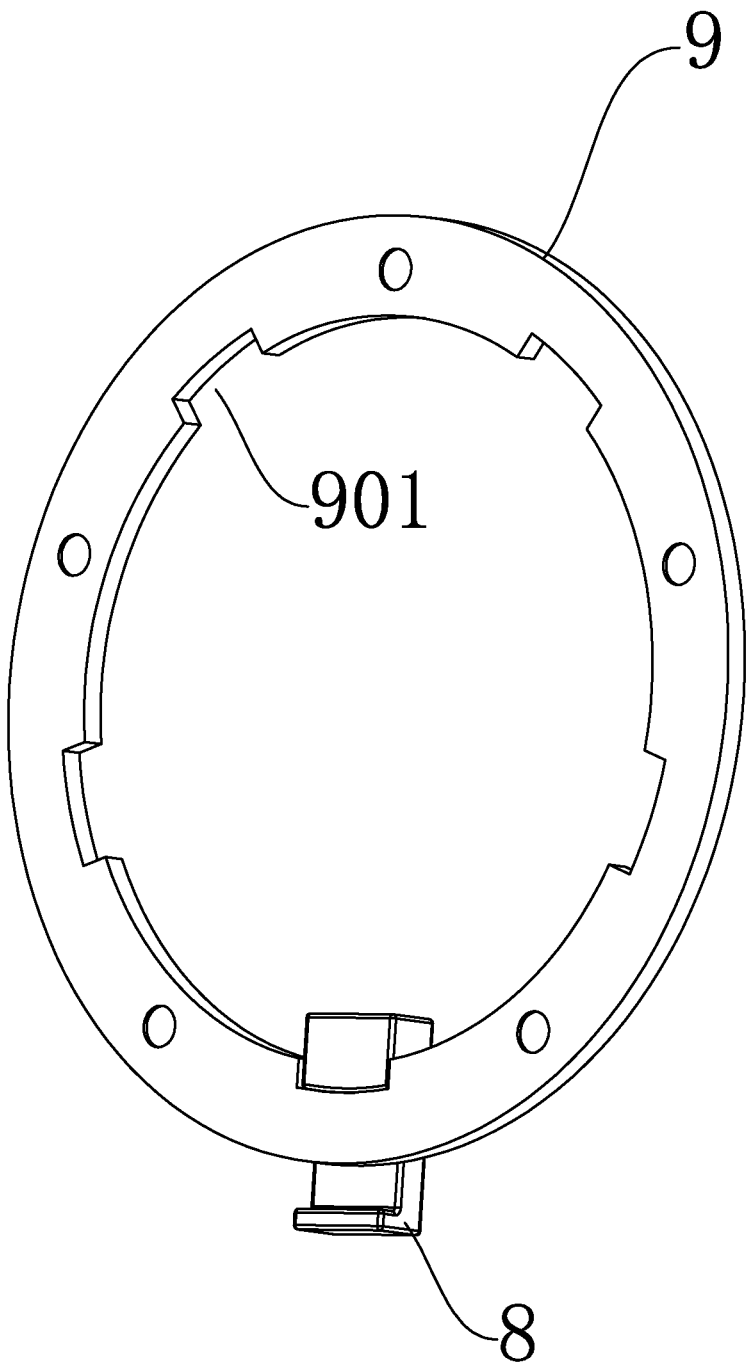
FIG. 13 is a schematic structural diagram of a rotary table in the present invention.

In the drawings: 1. dumbbell body; 2. dumbbell base; 201. placement groove; 202. plate groove; 203. anti-collision groove; 204. unlocking ejection block; 3. dumbbell plate; 301. clamping groove; 302. expanded hole; 4. dumbbell rod assembly; 401. handle; 402. shaft center; 403. telescopic sleeve; 404. tooth space; 5. dumbbell clamp assembly; 501. limit rack; 502. expansion chute; 503. division plate; 504. tail iron plate; 505. fixing disk; 506. marking groove; 507. dial plate; 508. internal gear ring; 509. gear set; 5091. master gear; 5092. pinion; 5093. driving gear; 510. limit frame; 6. limit barrel; 601. compression spring; 602. guide pin; 7. positioning plate; 701. guide groove; 702. guide surface; 8. limit block; 801. locking spring; 9. rotary table; and 901. locking groove.

DETAILED DESCRIPTION OF THE EMBODIMENTS

To make the technical means, creative features, achieved objectives, and effects of the present disclosure easy to understand, the present disclosure is further described below with reference to specific embodiments.

In FIG. 1 to FIG. 13, an adjustable dumbbell according to the present disclosure includes a dumbbell body 1, dumbbell plates 3, and a dumbbell base 2 for placing the dumbbell body 1 and the dumbbell plates 3. The dumbbell body 1 includes a dumbbell rod assembly 4 and two dumbbell clamp assemblies 5 configured to mount the dumbbell plates 3; the dumbbell rod assembly 4 includes a shaft center 402 in a prismatic structure and a handle 401 arranged in a middle of the shaft center 402 in a running fitting manner; the two dumbbell clamp assemblies 5 are fixed to two ends of the shaft center 402, respectively; each of the two dumbbell clamp assemblies 5 includes a limit rack 501 configured to mount the dumbbell plates 3, and a fixing disk 505 and a tail iron plate 504 configured to limit the mounted dumbbell plates 3; the fixing disk 505 and the tail iron plate 504 are fixed to two ends of the limit rack 501, respectively; an expansion chute 502 is horizontally provided in a position, corresponding to the shaft center 402, of a middle of the limit rack 501; the two ends of the shaft center 402 are both sleeved with telescopic sleeves 403 capable of sliding into the two expansion chutes 502 and configured to fix the dumbbell plates 3; gear sets 509 are provided in a running fitting manner at positions, located inside the two fixing disks 505, of one ends of the two limit racks 501; each of the two fixing disks 505 is internally provided with an internal gear ring 508 driven by the handle 401 in a running fitting manner; the two internal gear rings 508 drive the two telescopic sleeves 403 by the two gear sets 509 respectively to move; and limit blocks 8 capable of locking rotation of the internal gear rings 508 are arranged at positions, located inside the two fixing disks 505, of the one ends of the two limit racks 501. According to the dumbbell, the dumbbell plates 3 are fixed using the telescopic sleeves 403, and a number of the dumbbell plates 3 fixed by the two telescopic sleeves 403 is adjusted by changing extension lengths of the two telescopic sleeves 403 to adjust a weight of the dumbbell; the dumbbell is internally provided with the internal gear rings 508 and the gear sets 509 meshed therewith; and through cooperative transmission of the internal gear rings 508 and the gear sets 509, a user needs to rotate the handle 401 to drive the internal gear rings 508 to rotate during the weight adjustment of the dumbbell. The mounting weight of the dumbbell is adjusted by rotating the handle 401, making the dumbbell easier and more convenient to adjust. The dumbbell implements transmission in a mode of meshing the internal gear rings 508 with the gear sets 509 and meshing the gear sets 509 with teeth on the telescopic sleeves 403. On the one hand, a high transmission efficiency is achieved, a torque of the handle 401 can be more efficiently converted and transmitted to the telescopic sleeves 403, the telescopic sleeves 403 can make a faster response, and a weight adjustment speed of the dumbbell is increased, such that the usage efficiency of the dumbbell is improved; and on the other hand, a structure used in the transmission mode has greater load-bearing capacity, has higher wear resistance than a structure in a nut and lead screw mode, and there will be no situation where the dumbbell cannot be used due to thread wear after long-term use, thereby prolonging the service life of the dumbbell. In addition, the transmission mode has a higher positioning accuracy and can more accurately control positions of the telescopic sleeves 403, thereby enabling the telescopic sleeves 403 to fix the dumbbell plates 3 more reliably, effectively preventing the dumbbell plates 3 at end parts of the telescopic sleeves 403 from falling off, and thus achieving the higher safety and reliability of the dumbbell in use.

Each of the gear sets 509 includes a master gear 5091 and two driving gears 5093; the master gear 5091 is meshed with teeth of an inner ring of the internal gear ring 508; two sides of the master gear 5091 are both provided with pinions 5092 in a synchronous running fitting manner; the two driving gears 5093 are meshed with the two pinions 5092, respectively; each of the telescopic sleeves 403 is provided with a tooth space 404; and the telescopic sleeve 403 is meshed with the two driving gears 5093 through the tooth space 404. According to the dumbbell, the shaft center 402 in the prismatic structure is arranged, such that the telescopic sleeves 403 can be effectively prevented from rotating on the shaft center 402, the situation where the gear sets 509 cannot be matched with the tooth spaces 404 on the telescopic sleeves 403 due to axial rotation of the telescopic sleeves 403 is avoided, the horizontal movement of the telescopic sleeves 403 is more stable, and thus the weight adjustment of the dumbbell is smoother and more reliable; and the two driving gears 5093 are arranged on the gear set 509 and both matched with the tooth space 404 on the telescopic sleeve 403, such that it is ensured that two sides of the telescopic sleeve 403 are stressed stably, thus effectively solving the problem that the telescopic sleeve 403 is prone to shaking and jamming during the horizontal movement, and further improving the stability of the telescopic sleeve 403 during the horizontal movement and the smoothness and reliability of adjusting the dumbbell.

One side of the fixing disk 505 is provided with a dial plate 507 in a running fitting manner; one side of the dial plate 507 is marked with scales; one side of the fixing disk 505 is provided with a marking groove 506 pointing to the scales of the dial plate 507; a center of the dial plate 507 is fixed to the handle 401; one side, away from the handle 401, of the dial plate 507 is fixed to the internal gear ring 508 inside the fixing disk 505; and the handle 401 drives the internal gear ring 508 by the dial plate 507 to rotate. According to the dumbbell, the dial plate 507 with the scales and the fixing disk 505 with the marking groove 506 are arranged between the handle 401 and the internal gear ring 508, and the scales on the dial plate 507 are matched with the marking groove 506 on the fixing disk 505, such that a required weight can be conveniently selected and adjusted, and the user can align a specific scale on the dial plate 507 with the marking groove 506 as needed, thereby achieving precise weight adjustment. In addition, the scales on the dial plate 507 are matched with the marking groove 506 on the fixing disk 505, such that it can be effectively ensured that the extension length of the telescopic sleeve 403 can be corresponding to an integral multiple of a thickness of the dumbbell plates 3, the situation where the dumbbell plates 3 are not completely fixed by the telescopic sleeve 403 can be effectively avoided, and the situation where the dumbbell plates 3 fall off can be effectively avoided, thus further improving the safety of the dumbbell in use.

A positioning plate 7 is fixed between the dial plate 507 and the internal gear ring 508; the positioning plate 7 rotates synchronously with the dial plate 507; one side, away from the dial plate 507, of the positioning plate 7 is alternately provided with guide grooves 701 and guide surfaces 702 in an equal-radian manner; two limit barrels 6 are horizontally fixed to positions, located in the fixing disk 505, of the one end of the limit rack 501; a compression spring 601 is horizontally fixed in each of the two limit barrels 6; guide pins 602 capable of being compressed into the limit barrels 6 are connected to end parts of the two compression springs 601; and when abutting against the guide surfaces 702, the two guide pins 602 tend to slide towards any one of the guide grooves 701 on two sides of each of the guide surfaces 702, and the positioning plate 7 is driven to rotate, such that the guide pins 602 are located in the guide grooves 701. According to the dumbbell, the positioning plate 7 is arranged between the dial plate 507 and the internal gear ring 508, and rotates synchronously with the dial plate 507; the guide pins 602 squeeze the positioning plate 7 under elastic force of the compression springs 601; the side surface of the positioning plate 7 is alternately provided with the guide grooves 701 and the guide surfaces 702; when the two guide pins 602 abut against the guide surfaces 702, the marking groove 506 is not corresponding to any scale on the dial plate 507, and the adjustment of the dumbbell is in a neutral state, such that the dumbbell plates 3 at the end parts of the telescopic sleeve 403 are not fully penetrated, and there is a risk of falling; when the two guide pins 602 are located in the guide grooves 701, the marking groove 506 is corresponding to one of the scales on the dial plate 507, and the adjustment of the dumbbell is in a gear position, such that the dumbbell plates 3 at the end parts of the telescopic sleeve 403 are completely penetrated; because the guide pins 602 tend to slide towards any one of the guide grooves 701 on the two sides of each of the guide surfaces 702 when abutting against the guide surfaces 702, the guide pins 602 are prone to falling into the guide grooves 701, and when rotated and adjusted to adjust the weight of the dumbbell, the handle 401 is not easily adjusted to be in the neutral state, making gear shifting more reliable during the weight adjustment of the dumbbell; and the dumbbell plates 3 mounted on the dumbbell are all in a firm state by improving the reliability of the dumbbell during gear shifting, thus reducing the possibility of the dumbbell plates 3 falling, and further improving the safety and reliability of the dumbbell in use.

Each of the dumbbell plates 3 is provided with a clamping groove 301 into which the limit rack 501 is capable of being placed from top to bottom; an expanded hole 302 for each of the telescopic sleeves 403 to penetrate through is horizontally provided in a center of the dumbbell plate 3; a diameter of the telescopic sleeve 403 is greater than a width of the clamping groove 301; and the telescopic sleeve 403 penetrates into the expanded hole 302 to fix the dumbbell plate 3 to the limit rack 501. Because the diameter of the telescopic sleeves 403 is greater than the width of the clamping grooves 301, the dumbbell plates 3 can be fixed to the limit racks 501 after the telescopic sleeves 403 penetrate through the expanded holes 302; the limit racks 501 are placed in the clamping grooves 301, and the telescopic sleeves 403 penetrate through the expanded holes 302 to fix the dumbbell plates, such that it can be ensured that the dumbbell plates 3 are firmly connected to the limit racks 501, thus avoiding the situation where the dumbbell plates 3 are loosened or separated; and the arrangement of the clamping grooves 301 and the expanded holes 302 makes the dumbbell plates 3 more convenient and easier to mount, thus providing convenience for the weight adjustment of the dumbbell.

The limit rack 501 is provided with a plurality of division plates 503; the plurality of division plates 503 divide the limit rack 501 into a plurality of plate positions for fixing the dumbbell plates 3; and an outermost part of the clamping groove 301 on each of the dumbbell plates 3 is in an inverted splayed structure. The division plates 503 are arranged on the limit rack 501 to separate the mounted dumbbell plates 3 from one another, such that the plurality of dumbbell plates 3 are prevented from being squeezed and collided on the limit rack 501, a large gap between the mounted dumbbell plates 3 is prevented, it is ensured that a size of a position of each dumbbell plate 3 on the limit rack 501 is fixed, and thus it is avoided that the extension length of the telescopic sleeve 403 cannot be matched with the overall thickness of the mounted dumbbell plates 3 during gear shifting. The outermost part of the clamping groove 301 is set to be in the inverted splayed structure for guiding the process of placing the limit rack 501 in the clamping grooves 301, such that the limit rack 501 can be more easily placed in the clamping grooves 301, and the dumbbell body 1 can be matched with the dumbbell plates 3 more conveniently, thus improving the convenience in use and adjustment of the dumbbell.

One side of the internal gear ring 508 is fixedly provided with an annular rotary table 9; an inner ring of the rotary table 9 is provided with a plurality of locking grooves 901 in an equal-radian manner; lowermost parts of end parts of the limit rack 501 are both fixedly provided with limit frames 510; the limit frames 510 are internally provided with the limit blocks 8 in a sliding fitting manner; the limit blocks 8 are in an inverted L-shaped structure; locking springs 801 are connected to tops of the limit blocks 8; tops of the locking springs 801 are connected to interiors of the limit frames 510; the limit blocks 8 are pressed down into the locking grooves 901 under the action of the locking springs 801; and the rotation of the internal gear ring 508 is restricted by the rotary table 9. No matter how to rotate the handle 401, the limit block 8 is always kept in a state of being corresponding to one of the locking grooves 901 on the rotary table 9 as long as the weight adjustment of the dumbbell is in the gear position; the limit blocks 8 are squeezed by elastic force of the locking springs 801 to be inserted into the locking grooves 901, such that the rotary table 9 can be fixed; the internal gear rings 508 and the handle 401 are not rotatable by fixing the rotary tables 9, and then the telescopic sleeves 403 are not movable, such that the number of the dumbbell plates 3 mounted on the dumbbell is fixed, thus achieving the purpose of locking the required weight of the dumbbell; moreover, the handle 401 is not rotatable by fixing the rotary tables 9, and the dumbbell does not slide when the user lifts up the dumbbell by the handle 401, such that it is ensured that the user can hold the dumbbell more firmly, thus improving the reliability of the dumbbell in use.

Unlocking ejection blocks 204 are welded at a top of the dumbbell base 2; the limit blocks 8 are corresponding to the unlocking ejection blocks 204 in position; and after the dumbbell body 1 is placed in the dumbbell base 2, the unlocking ejection blocks 204 squeeze up the limit blocks 8, such that the limit blocks 8 are capable of being ejected from the locking grooves 901. Through the arrangement of the unlocking ejection blocks 204, after the dumbbell is placed on the dumbbell base 2, the unlocking ejection blocks 204 squeeze up the limit blocks 8 to eject the limit blocks 8 from the locking grooves 901, such that the rotary table 9 is restored to a state where the rotary plate is rotatable, and thus the dumbbell is restored to a state where the weight adjustment is available. Through the arrangement of the unlocking ejection blocks 204, the weight of the dumbbell can be adjusted as long as the dumbbell is put back on the dumbbell base 2 after training, such that a step of manually unlocking the weight adjustment of the dumbbell is omitted, and the convenience in weight adjustment of the dumbbell is further improved. In addition, once the dumbbell is removed from the dumbbell base 2, the limit blocks 8 are not supported by the unlocking ejection blocks 204 and pushed directly into the locking grooves 901 by the locking springs 801, such that a step of manually locking the weight adjustment of the dumbbell is omitted, the convenience in weight adjustment of the dumbbell is further improved, and the occurrence of accidents caused by the user forgetting to lock a dumbbell weight adjustment function can be avoided, thus further improving the reliability of the dumbbell in use.

Each of two ends of the top of the dumbbell base 2 is provided with a placement groove 201 configured to place a corresponding one of the dumbbell clamp assemblies 5; a plurality of plate grooves 202 configured to store the dumbbell plates 3 are provided in a position, located in a middle of each of the two placement grooves 201, of the top of the dumbbell base 2; and an anti-collision groove 203 is provided in a center of the top of the dumbbell base 2 and is corresponding to the handle 401 in position. The placement grooves 201 at the top of the dumbbell base 2 can be configured to place the dumbbell clamp assemblies 5, and the plate grooves 202 at the top of the dumbbell base 2 can be configured to place the dumbbell plates 3. The dumbbell base 2 is arranged, and the placement grooves 201 and the plate grooves 202 are provided on the dumbbell base 2, such that the dumbbell is not easily lost during use, and it is convenient to classify, arrange and select dumbbells. The anti-collision groove 203 is provided on the dumbbell base 2, such that a sufficient distance is kept between the top of the dumbbell base 2 and the handle 401 of the dumbbell, thus avoiding the situation where a hand of the user is pinched by the dumbbell base 2 and the handle 401 of the dumbbell during the placement of the dumbbell, reducing accidental injuries, and making the dumbbell safer to use.

The two gear sets 509 are arranged in a central symmetry manner; the two internal gear rings 508 are centrally symmetric; the two internal gear rings 508 rotate synchronously in a same direction; the two internal gear rings 508 drive the two telescopic sleeves 403 by the two gear sets 509 respectively to move synchronously in opposite directions; two ends of the handle 401 are set to be hollow; and the two telescopic sleeves are capable of retracting into the two ends of the handle 401. The telescopic sleeves 403 are retracted into the handle 401, such that the telescopic sleeves 403 are not easily exposed outside, thus preventing jamming caused by sundries wound around the telescopic sleeves 403.

Figure 14:
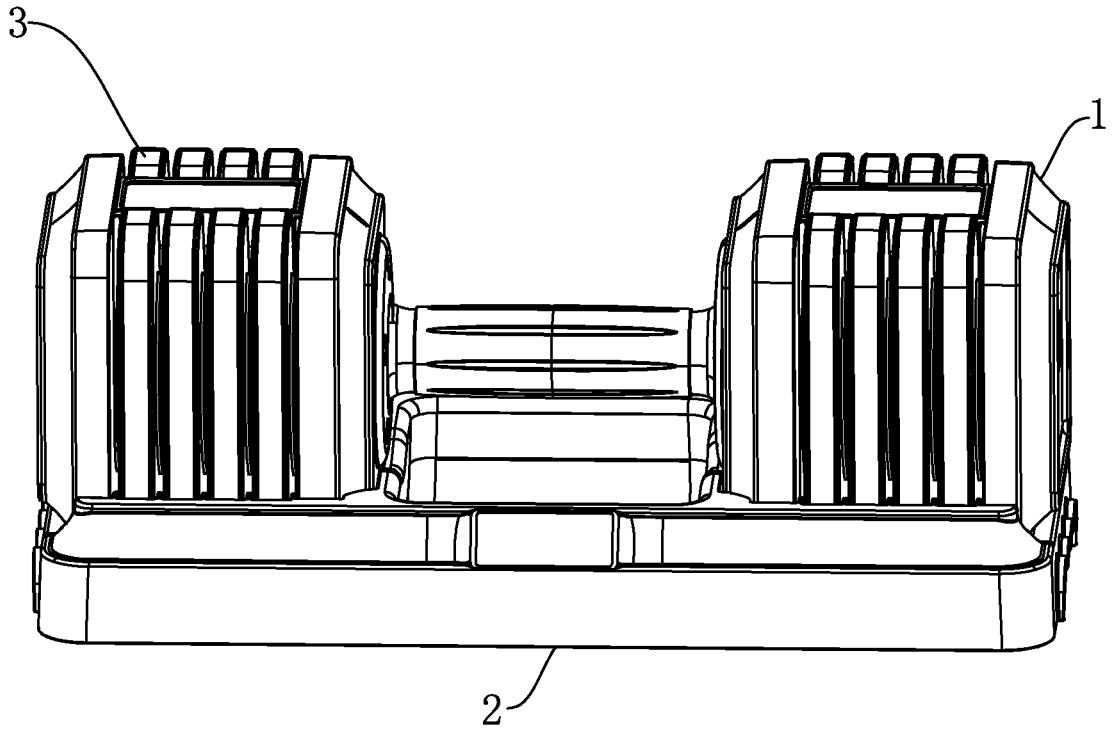
FIG. 14 is a schematic diagram of an overall structure of Embodiment 1 of the present invention.
Figure 15:
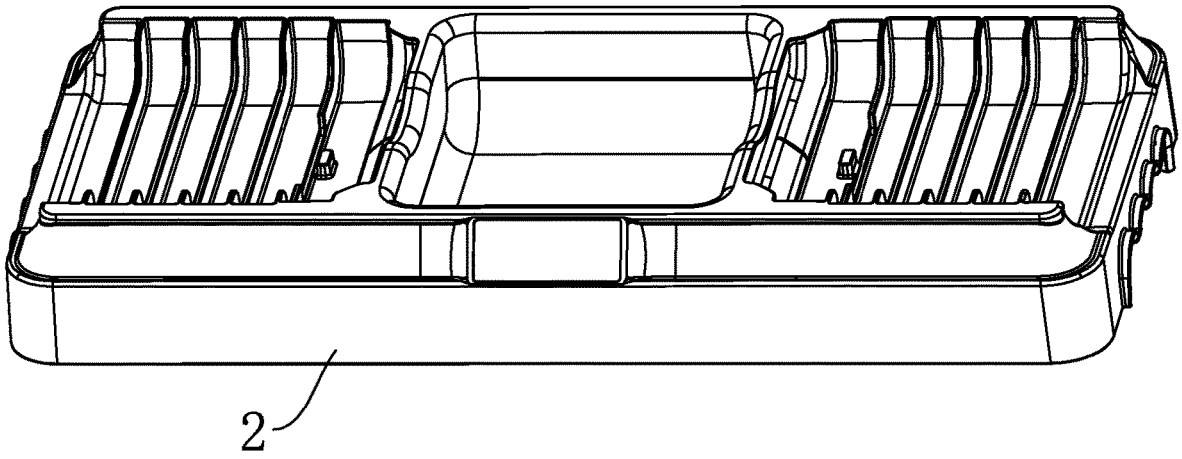
FIG. 15 is a schematic structural diagram of a dumbbell base in Embodiment 1 of the present invention.
Figure 16:
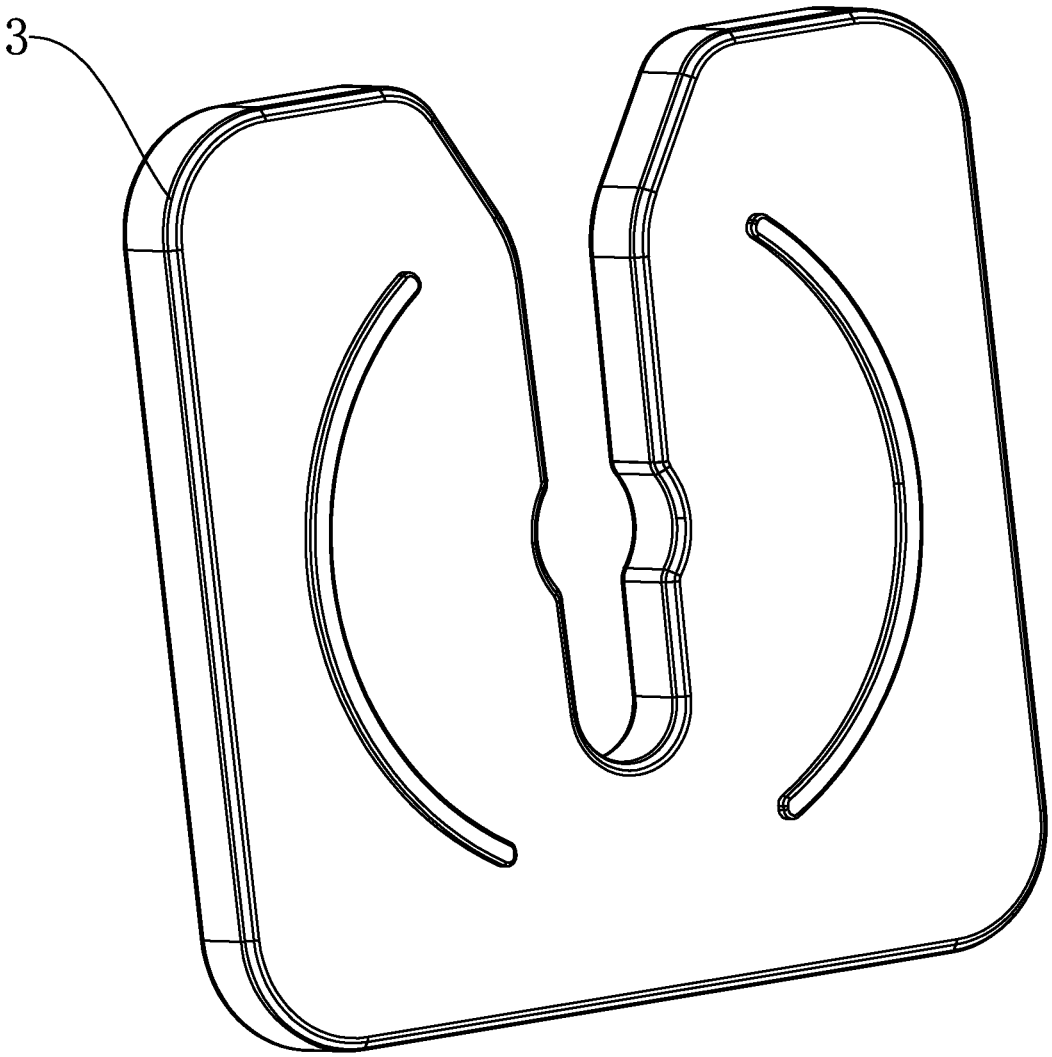
FIG. 16 is a schematic structural diagram of a dumbbell plate in Embodiment 1 of the present invention.

In an embodiment shown in FIG. 14 to FIG. 16, sections of the two dumbbell clamp assemblies 5 on the dumbbell body 1 are both in a square structure, and all the dumbbell plates 3 are in a square structure. The placement grooves 201 at the top of the dumbbell base 2 are matched with the dumbbell clamp assemblies 5 in the square structure, and the plate grooves 202 at the top of the dumbbell base 2 are matched with the dumbbell plates 3 in the square structure. When the dumbbell clamp assemblies 5 and the dumbbell plates 3 are set to be of the square structure, on the one hand, the entire dumbbell formed by the dumbbell clamp assemblies 5 and the dumbbell plates 3 of the square structure does not roll around on the ground, making it more stable and safer to use; and on the other hand, the dumbbell clamp assemblies 5 and the dumbbell plates 3 of the square structure are easier to align with the dumbbell base 2, making it more convenient for the user to place the dumbbell, and in particular, it is required to align the limit blocks 8 at the bottom with the unlocking ejection blocks 204.

Figure 17:
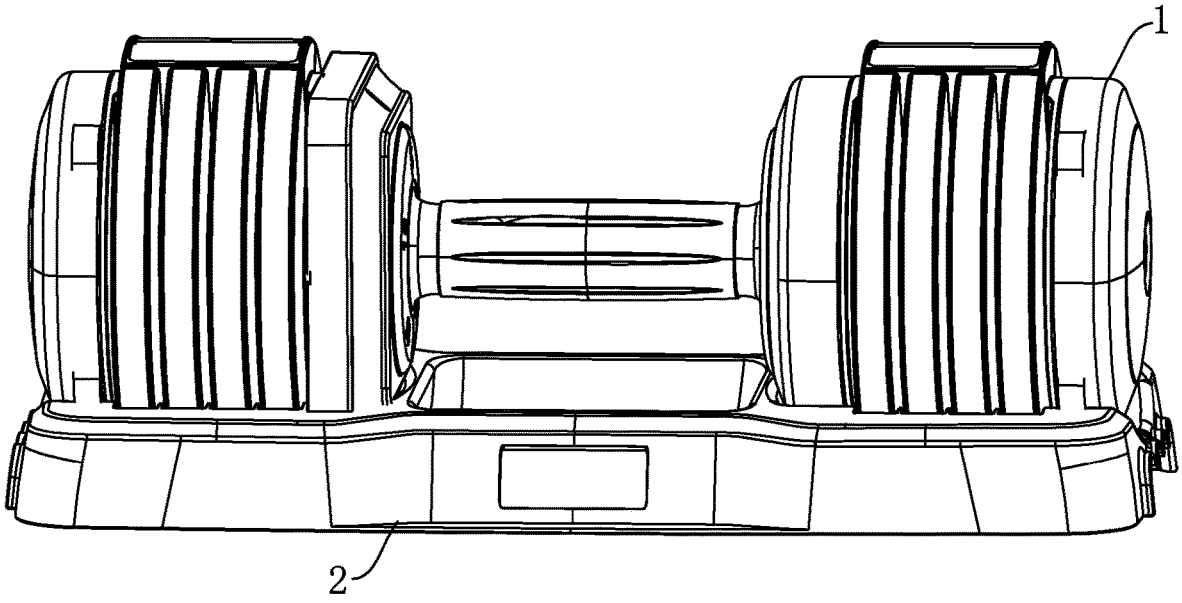
FIG. 17 is a schematic diagram of an overall structure of Embodiment 2 of the present invention.

In another embodiment shown in FIG. 17, sections of the two dumbbell clamp assemblies 5 on the dumbbell body 1 are in a circular structure, moreover, all the dumbbell plates 3 are in a circular structure, and one of the fixing disks 505 is set to be of a square structure. The dumbbell plates 3 and the dumbbell clamp assemblies 5 of the circular structure can make center of gravity of the dumbbell more stable, such that the dumbbell is more easily kept balanced in use. The fixing disk 505 of the square structure can ensure that the dumbbell does not roll around on the ground, making it more stable and safer to use and making it more convenient for the user to place the dumbbell, and in particular, it is required to align the limit blocks 8 at the bottom with the unlocking ejection blocks 204.

During use, first, the dumbbell base 2 is placed on a horizontal table or the ground, the dumbbell plates 3 are put into the plate grooves 202 of the dumbbell base 2, and openings of the clamping grooves 301 of the dumbbell plates 3 face right above, to ensure that the two telescopic sleeves 403 are completely moved out of the two expansion chutes 502; the two limit racks 501 on the dumbbell body 1 are aligned with the dumbbell plates 3 placed at the two ends of the top of the dumbbell base 2, respectively; and the dumbbell body 1 is placed downwards, such that the limit racks 501 are inserted into the clamping grooves 301 of the dumbbell plates 3. In this case, the two dumbbell clamp assemblies 5 are placed in the two placement grooves 201 at the top of the dumbbell base 2, and the unlocking ejection blocks 204 on the dumbbell base 2 squeeze up the limit blocks 8 to move the limit blocks 8 out of the locking grooves 901 of the rotary tables 9, causing the rotary tables 9 to be in a state where the rotary tables are rotatable and adjustable. The placement grooves 201 at the top of the dumbbell base 2 can be configured to place the dumbbell clamp assemblies 5, and the plate grooves 202 at the top of the dumbbell base 2 can be configured to place the dumbbell plates 3. The dumbbell base 2 is arranged, and the placement grooves 201 and the plate grooves 202 are provided on the dumbbell base 2, such that the dumbbell is not easily lost during use, and it is convenient to classify, arrange and select dumbbells. The anti-collision groove 203 is provided on the dumbbell base 2, such that a sufficient distance is kept between the top of the dumbbell base 2 and the handle 401 of the dumbbell, thus avoiding the situation where the hand of the user is pinched by the dumbbell base 2 and the handle 401 of the dumbbell during the placement of the dumbbell, reducing the accidental injuries, and making the dumbbell safer to use. Through the arrangement of the unlocking ejection blocks 204, the weight of the dumbbell can be adjusted as long as the dumbbell is put back on the dumbbell base 2 after training, such that the step of manually unlocking the weight adjustment of the dumbbell is omitted, and the convenience in weight adjustment of the dumbbell is further improved. In addition, once the dumbbell is removed from the dumbbell base 2, the limit blocks 8 are not supported by the unlocking ejection blocks 204 and pushed directly into the locking grooves 901 by the locking springs 801, such that the step of manually locking the weight adjustment of the dumbbell is omitted, the convenience in weight adjustment of the dumbbell is further improved, and the occurrence of accidents caused by the user forgetting to lock the dumbbell weight adjustment function can be avoided, thus further improving the reliability of the dumbbell in use. Then, the handle 401 is rotated to drive the two dial plates 507 to rotate; and according to fitness requirements, the required weight indicating scales on the dial plates 507 are rotated to be aligned with the marking grooves 506 on the fixing disks 505. During the process of rotating the two dial plates 507, the two internal gear rings 508 are driven to rotate and drive the two telescopic sleeves 403 by the two gear sets 509 to move away from the handle 401, and the two telescopic sleeves 403 penetrate through the corresponding number of the dumbbell plates 3 from the expansion chutes 502 based on the rotational amplitudes of the dial plates 507. According to the dumbbell, the dial plate 507 with the scales and the fixing disk 505 with the marking groove 506 are arranged between the handle 401 and the internal gear ring 508, and the scales on the dial plate 507 are matched with the marking groove 506 on the fixing disk 505, such that the required weight can be conveniently selected and adjusted, and the user can align a specific scale on the dial plate 507 with the marking groove 506 as needed, thereby achieving the precise weight adjustment. In addition, the scales on the dial plate 507 are matched with the marking groove 506 on the fixing disk 505, such that it can be effectively ensured that the extension length of the telescopic sleeve 403 can be corresponding to the integral multiple of the thickness of the dumbbell plates 3, the situation where the dumbbell plates 3 are not completely fixed by the telescopic sleeve 403 can be effectively avoided, and the situation where the dumbbell plates 3 fall off can be effectively avoided, thus further improving the safety of the dumbbell in use. Finally, the handle 401 is held with a hand and the dumbbell body 1 is lifted up. The dumbbell plates 3 penetrated by the telescopic sleeves 403 are fixed to the dumbbell clamp assemblies 5 because the diameter of the telescopic sleeves 403 is greater than the width of the clamping grooves 301 on the dumbbell plates 3, moreover, the limit blocks 8 are not squeezed by the unlocking ejection blocks 204 and fall back into the locking grooves 901 of the rotary tables 9 under the elastic force of the locking springs 801 to lock the rotary tables 9 for preventing rotation of the rotary tables 9, and the internal gear rings 508, the dial plates 507, and the handle 401 are all kept in a locked state by locking the rotary tables 9, such that the user is capable of making exercise according to an adjusted weight. Because the diameter of the telescopic sleeves 403 is greater than the width of the clamping grooves 301, the dumbbell plates 3 can be fixed to the limit racks 501 after the telescopic sleeves 403 penetrate through the expanded holes 302; the limit racks 501 are placed in the clamping grooves 301, and the telescopic sleeves 403 penetrate through the expanded holes 302 to fix the dumbbell plates, such that it can be ensured that the dumbbell plates 3 are firmly connected to the limit racks 501, thus avoiding the situation where the dumbbell plates 3 are loosened or separated; and the arrangement of the clamping grooves 301 and the expanded holes 302 makes the dumbbell plates 3 more convenient and easier to mount, thus providing convenience for the weight adjustment of the dumbbell. No matter how to rotate the handle 401, the limit block 8 is always kept in a state of being corresponding to one of the locking grooves 901 on the rotary table 9 as long as the weight adjustment of the dumbbell is in the gear position; the limit blocks 8 are squeezed by elastic force of the locking springs 801 to be inserted into the locking grooves 901, such that the rotary table 9 can be fixed; the internal gear rings 508 and the handle 401 are not rotatable by fixing the rotary tables 9, and then the telescopic sleeves 403 are not movable, such that the number of the dumbbell plates 3 mounted on the dumbbell is fixed, thus achieving the purpose of locking the required weight of the dumbbell; moreover, the handle 401 is not rotatable by fixing the rotary tables 9, and the dumbbell does not slide when the user lifts up the dumbbell by the handle 401, such that it is ensured that the user can hold the dumbbell more firmly, thus improving the reliability of the dumbbell in use.

The above shows and describes the basic principles, main features and advantages of the present invention. Those skilled in the art should understand that the present disclosure is not limited by the above embodiments. The above embodiments and descriptions in the specification illustrate the principle of the present invention. Without departing from the spirit and scope of the present invention, the present disclosure may also be subjected to various variations and improvements, all of which fall within the scope of protection of the present invention. The scope of protection of the present disclosure is defined by the appended claims and their equivalents.

What is claimed is:

1. An adjustable dumbbell, comprising a handle assembly and a counterweight assembly, wherein the counterweight assembly comprises a dumbbell plate, the handle assembly comprises a telescopic rod and a handle, each of two ends of the telescopic rod is provided with a dumbbell clamp assembly, the dumbbell clamp assembly is provided with a hanging cavity for hanging the dumbbell plate, the handle rotatably cooperates with the dumbbell clamp assembly, and the handle sleeves outside the telescopic rod; the telescopic rod has a prismatic shape, each of the two ends of the telescopic rod are movably sleeved with a telescopic sleeves that is movable into the hanging cavities, and the telescopic sleeve is provided with a tooth recess in a length direction of the telescopic sleeve; a gear drive assembly is arranged in the dumbbell clamp assembly, the gear drive assembly meshes with the tooth recess to drive the telescopic sleeve to translate along the telescopic rod, an end of the handle is provided with a rotary portion, the rotary portion is provided with a meshing gear meshing with the gear drive assembly, the rotary portion is further provided with a gear guide plate fixedly, the gear guide plate is provided with a plurality of guide recesses, a guide member is arranged between two adjacent guide recesses, and the guide member is provided with a guide surface; and the dumbbell clamp assembly is provided with a positioning assembly, the positioning assembly comprises a positioning member, the positioning member elastically presses against the gear guide plate, and when the positioning member presses against the guide surface, the positioning member tends to slide towards one of guide recesses in two sides of the guide surface, and drives the gear guide plate to rotate so as to cause the positioning member to be located in the guide recess.

2. The adjustable dumbbell according to claim 1, wherein two sides of the guide member are provided with inclined sliding surfaces, the guide surface is located between the two sliding surfaces, and the guide surface is a cambered surface in smooth transition to the sliding surfaces.

3. The adjustable dumbbell according to claim 1, wherein the plurality of the guide recesses is uniformly distributed in a side surface of the gear guide plate annularly, and the gear guide plate detachably cooperates with the rotary portion.

4. The adjustable dumbbell according to claim 1, wherein a plurality of positioning assemblies corresponding to the guide recesses are arranged in the dumbbell clamp assembly, and a contact surface between the positioning member and the gear guide plate is a cambered surface.

5. The adjustable dumbbell according to claim 4, wherein the positioning assembly comprises a positioning seat, the positioning member is movably arranged in the positioning seat, and a compression spring for pressing the positioning member is further arranged in the positioning seat.

6. The adjustable dumbbell according to claim 1, wherein the telescopic sleeve is provided with a sliding hole matching the telescopic rod, and the telescopic sleeve is attached to the telescopic rod.

7. The adjustable dumbbell according to claim 1, wherein the gear drive assembly comprises a drive gear, and the drive gear comprises a driving gear, and a driven gear and an intermediate gear that are coaxially and fixedly arranged; the driven gear meshes with the meshing gear, and the intermediate gear meshes with the driving gear; and the driving gear meshes with the tooth recess.

8. The adjustable dumbbell according to claim 7, wherein intermediate gears are fixedly arranged at two sides of the driven gear, each intermediate gear meshes with a corresponding driving gear, and an outer side of the telescopic sleeve is provided with the tooth recesses meshing with corresponding driving gears abreast.

9. The adjustable dumbbell according to claim 7, wherein the dumbbell clamp assembly is provided with a fixed seat, and the fixed seat is provided with two opposite support plates; the gear drive assembly is rotatably arranged between the two opposite support plates, and the fixed seat is provided with a stretchable hole; and the telescopic sleeve is laterally movably arranged in the stretchable hole.

10. The adjustable dumbbell according to claim 1, further comprising an unlocking disc and a locking assembly arranged on the dumbbell clamp assembly and used for locking the handle, wherein the locking assembly comprises a locking recess and a locking block, the locking block is slidably arranged in the locking recess, and a locking spring for pressing the locking block is arranged in the locking recess; the rotary portion is provided with a rotation stop recess in snap fit with the locking block, and the unlocking disc is provided with an unlocking member corresponding to the locking block; and when the positioning member is located in the guide recess, the locking block is aligned with the rotation stop recess; and when the dumbbell clamp assembly is placed in the unlocking disc, the unlocking member lifts the locking block so as to make the locking assembly in an unlocked state.

* * * * *